US006126166A

United States Patent [19]

Lorson et al.

[11] Patent Number: 6,126,166

[45] Date of Patent: Oct. 3, 2000

[54] CARD-RECOGNITION AND GAMING-CONTROL DEVICE

[75] Inventors: Raymond K. Lorson, Seabrook, N.H.; Robin J. Sainsbury, Cherry Hill; Neil S. Kenig, Mount Laurel, both of N.J.

[73] Assignee: Advanced Casino Technologies, Inc., Cherry Hill, N.J.

[21] Appl. No.: 08/957,620

[22] Filed: Oct. 24, 1997

Related U.S. Application Data

[60] Provisional application No. 60/030,095, Oct. 28, 1996.

[51] Int. Cl.[7] ..... A63F 9/24

[52] U.S. Cl. ..... 273/148 R; 273/149 R; 273/309; 273/148 A; 463/12; 463/47

[58] Field of Search ..... 434/129; 364/410.1, 364/411.1, 412.1; 463/11, 12, 29, 46, 25, 47; 273/148 A, 148 R, 149 R, 149 D, 292, 293, 296, 309

[56] References Cited

U.S. PATENT DOCUMENTS

| | | | |
|---|---|---|---|
| 4,531,187 | 7/1985 | Uhland . | |
| 4,586,712 | 5/1986 | Lorber et al. | 273/149 R |
| 4,951,950 | 8/1990 | Normand et al. | 273/149 R |
| 4,969,648 | 11/1990 | Hollinger | 273/149 R |
| 5,000,453 | 3/1991 | Stevens et al. | 273/149 R |
| 5,312,104 | 5/1994 | Miller . | |
| 5,362,053 | 11/1994 | Miller . | |
| 5,364,106 | 11/1994 | Laughlin et al. . | |
| 5,374,061 | 12/1994 | Albrecht . | |
| 5,403,015 | 4/1995 | Forte et al. . | |
| 5,586,936 | 12/1996 | Bennett et al. | 463/25 |
| 5,605,334 | 2/1997 | McCrea, Jr. | 273/309 |
| 5,632,483 | 5/1997 | Garczynski et al. . | |
| 5,669,816 | 9/1997 | Garczynski et al. . | |
| 5,722,893 | 3/1998 | Hill et al. | 463/29 |
| 5,795,225 | 8/1998 | Jones et al. | 463/29 |
| 5,803,808 | 9/1998 | Strisower | 463/12 |
| 5,831,527 | 11/1998 | Jones, II et al. | 463/12 |
| 5,919,090 | 7/1999 | Mothwurf | 463/12 |
| 5,941,769 | 8/1999 | Order | 463/12 |

OTHER PUBLICATIONS

"Better Safe Than Sorry" by Roger Gros, Casino Player. Sep. 1995.

*Primary Examiner*—Valencia Martin-Wallace
*Assistant Examiner*—John M. Hotaling, II
*Attorney, Agent, or Firm*—Steve Mendelsohn

[57] ABSTRACT

An integrated blackjack game control system having multiple sensors and output devices, electronic signal processing equipment, passive and active operator control devices, and a computer system. The system components are capable of being installed on or near existing blackjack tables and support equipment, and to operate with standard playing cards. The system performs several simultaneous functions to accelerate the play of a game of blackjack, enhance the shuffling process, and perform continuous monitoring of key dealer and table performance attributes.

24 Claims, 9 Drawing Sheets

CARD-RECOGNITION AND GAMING-CONTROL DEVICE

This nonprovisional U.S. national application, filed under 35 U.S.C. § 111(a), claims, under 35 U.S.C. § 119(e)(1), the benefit of the filing date of provisional U.S. national application No. 60/030,095, filed under 35 U.S.C. § 111(b) on Oct. 28, 1996, the teachings of which are incorporated herein by reference.

BACKGROUND OF THE INVENTION

1. Field of the Invention

The invention relates to systems for monitoring the playing of card games, and, particular, to systems for monitoring the playing of blackjack in casinos.

2. Description of the Related Art

Blackjack is a card game commonly played in casinos worldwide. The game is played by one or more players who compete individually against a dealer. The dealer represents the casino and performs the necessary game operational tasks. The object of the game is to achieve a total card value as close to but not greater than twenty-one.

The casino maintains a statistical advantage over the player since the dealer (i.e., casino) wins anytime the player's hand exceeds a total value of twenty-one regardless of the outcome of the dealer's hand. A knowledgeable player can reduce the casino's advantage by the proper execution of various play options available only to the player. Blackjack games are played with one or more decks of cards, and typically multiple rounds are completed before the cards are shuffled. Normally, blackjack games played with more than two decks of cards are dealt from a card-dispensing device commonly referred to as a shoe.

Blackjack is unique among games of chance in that the casino's statistical advantage continuously varies during play based on the number and types of cards removed. The removal of cards during each round of play affects the ratio of the high-value cards to the low-value cards remaining in the shoe. This ratio, which directly affects the casino's statistical advantage over the player, can vary widely during play for a number of reasons including an incomplete shuffling process. Specifically, the casino's advantage increases as the deck is depleted of high-value cards and decreases as the deck is depleted of low-value cards as described in "The Theory of Blackjack" by Griffin (Huntington Press, 1988). Periodically, enough low-valued cards will be removed from the deck to shift the advantage to the player.

A minority of players, commonly referred to as card counters, track the cards removed during play to determine the statistical condition of the remaining cards in the shoe. The card counter utilizes this information to adjust his bet level before each round of play, and also to determine the proper play strategy. For example, a card counter might place a small bet if the deck favored the casino and then increase the bet size when the deck favored the player. By altering bets in this manner, the card counter is able to achieve a statistical advantage over the casino. Some card counters, who are also known as shuffle trackers, can determine the statistical condition of selected card segments following completion of the shuffling process to adjust their bet size prior to play of the tracked segments.

Currently, casinos implement various active and passive countermeasures to limit their vulnerability to card counters and shuffle trackers. Active countermeasures are implemented as required and directed towards individual players whom the casino suspects are card counters. Active countermeasures may include one or more of the following: barring the individual from play, bet restrictions, and frequent shuffling. The active countermeasures provide some protection to the casino, but there are several weaknesses associated with these measures including: the period of time required to collect and analyze sufficient data to confirm that a suspected player is a card counter, the extensive commitment of casino resources required to continuously evaluate all blackjack players in the casino to detect the card counters, the inability of current methods for detecting card counters to detect shuffle trackers, and statutory prohibitions against some casinos from implementing one or more of the active countermeasures. Additionally, the active countermeasures introduce an element of confrontation between the casino patrons and employees that can detract from the entertainment aspects of the gaming industry.

To compensate for the weaknesses associated with the active countermeasures, casinos typically implement one or more passive countermeasures to limit the effectiveness of card counters. The passive countermeasures are continuously in effect and impact all players in the casino. These countermeasures may include one or more of the following: rule changes to shift the game's statistical advantage more in favor of the casino, reducing the number of rounds played between shuffles, restricting players from entering the game after the first round of play, and implementing complex shuffling patterns to foil shuffle trackers. The passive countermeasures are effective, but they also reduce the speed at which the game is played. Since the casino maintains a statistical advantage over the majority of players, the reduced game speed adversely impacts casino revenue. Also, the decreased game speed and rule changes tend to make the game less enjoyable for the majority of casino patrons.

Recently several computer-based technologies have been designed to enhance the casino's ability to identify card counters. One method described in "Surveillance Goes High-Tech—Spying on the Eye-in-the-Sky" by Arnold Snyder (Blackjack Forum, April 1997) requires the casino to manually enter the cards played, bet size, and playing options selected by an individual player into a computer software program that determines if the player is a card counter. Another technique described in U.S. Pat. No. 5,374,061 to Albrecht involves a system that identifies and assigns a count value to specially marked and coded cards as they are dealt from the card-dispensing shoe. The Albrecht system then displays the count value to assist casino personnel in determining whether a player's bet pattern is characteristic of a card counter. A similar, but more advanced system, described in "Better Safe Than Sorry" by Gros (Casino Player, September 1995) monitors both the count and variations in a player's bet pattern to determine if the bet pattern is characteristic of a card counter. A weakness with the latter system is that it requires use of a special dispensing shoe that is integral with a special blackjack table. The special system components are expensive and the fixed shoe location is uncomfortable for the dealers and a potential source of injury since the dealers are unable to properly position the shoe to account for varying body sizes.

The systems disclosed above enhance the casino's ability to detect card counters from among the other blackjack players and initiate active countermeasures against the suspected card counters. These systems, however, do not eliminate the remaining weaknesses associated with the active countermeasures and would require the casino to maintain one or more of the revenue-reducing passive countermeasures. Therefore, a need exists for a system that can limit the casino's vulnerability to card counters and shuffle trackers without adversely affecting casino revenue or the general public.

SUMMARY OF THE INVENTION

The present invention passively neutralizes the advantage to both card counters and shuffle trackers by improving the shuffling process to reduce the deck's statistical variations that are essential for both card counters and shuffle trackers. The present invention would then allow the casino to reduce or perhaps eliminate the other current active and passive countermeasures. The general public would not be affected by the improved shuffling process since the integrated casino advantage would remain constant. System and dealer performance will be continuously monitored and appropriate personnel will be alerted if pre-selected deck statistical limits are exceeded. This feature provides an additional benefit of allowing the casino to focus attention on the affected table to determine if any of the players are card counters.

The present invention is fully compatible with standard casino blackjack equipment and requires only a minor change to current shuffling practices. The invention includes a real-time card-recognition device that can be readily installed on any blackjack table or contained within a commercially available card-dispensing shoe. The invention integrates various functions that are designed to accelerate play of the game and to improve the game oversight process and management of dealers.

The present invention accelerates the game by eliminating the time delay associated with the unnecessary completion of play when the dealer receives a blackjack. A blackjack hand occurs when the first two cards received by either the dealer or the player consist of both an ace and any ten-valued card. The recipient of the blackjack hand automatically wins the game. Since one of the dealer's cards is dealt face down, the dealer may not recognize that he has a blackjack until his face down card is revealed following completion of all of the players' hands. This slows down the speed of the game since time is unnecessarily expended while the players execute their various play options.

Some casinos, in order to speed up the game, have allowed the dealers to manually view their face down card when their face up card is either a ten or an ace. This activity introduces risk since the player is provided an opportunity, through intentional or unintentional dealer action, to acquire knowledge of the dealer's face down card. A player who consistently obtains and properly utilizes this information could achieve up to a 3% advantage over the casino as indicated in "Million Dollar Blackjack" by Uston (1981, Carol Publishing Group).

Prior art includes several systems developed to indicate when the dealer has a blackjack without requiring the dealer to manually view his face-down card. These systems are described in U.S. Pat. Nos. 5,312,104, and 5,362,053 to Miller, U.S. Pat. No. 5,364,106 to Laughlin et al., U.S. Pat. No. 5,403,015 to Forte et al., and U.S. Pat. No. 5,632,483 to Garczynski et al. The systems disclosed in these references require the use of specially encoded playing cards and/or the dealer to perform an active function. The current invention improves these methods by eliminating the need for specialized or coded playing cards and eliminates the active dealer function.

Dealer oversight and control must be effective to ensure a successful blackjack game. The dealer must be supervised to ensure that casino rules and policies are strictly and continuously enforced. Current oversight practices rely on periodic, manual, and subjective observations of dealer performance by supervisory and security personnel. These practices do not achieve the level of oversight that can be provided by a continuous, real-time system, like that of the present invention, designed to monitor, trend, and objectively measure key dealer performance attributes and table utilization information.

The present invention passively monitors, trends and objectively measures critical dealer performance tasks including, but not limited to shuffling adequacy, number of cards dealt before shuffling, average time required to complete various game operations, and the number of cards dealt within a specified time period. The casino would utilize this information to implement appropriate corrective actions to maintain acceptable dealer performance.

The present system requires minimal active user functions and can be readily installed on or attached to existing commercially available casino blackjack tables and support equipment.

In one embodiment, multiple sensors are mounted at pre-determined locations in a standard card-dispensing shoe. The precise sensor arrangement may vary depending on the required precision and the style of card being detected. Each sensor generates an output signal indicative of whether the portion of card passing over the sensor is white or non-white. The non-white portions of the card are associated with the pips printed on standard playing cards. The integrated sensor output signal is unique for a given card value. The system interprets the integrated output signal utilizing a transition-based methodology to detect the card pips.

A separate input sensor is mounted on the planar surface of the blackjack table in the area where the dealer's cards are placed during play of the hand. This sensor detects the presence or absence of a card and is used to determine the number of players in each round, detect the end of a round of play, and control one of the system output devices.

The sensors are connected to a signal conditioning circuit which can be mounted to the underside of the blackjack table in close proximity to the sensors. The signal conditioning circuit conditions the sensor output signals to support transmission to a remote data acquisition system.

The data acquisition system provides the interface between a system computer and the signal conditioning circuit. The sensor output signals are transferred to the system computer at a pre-determined rate to ensure proper detection of all card values. The system computer determines the card values and also executes several software programs to support the remaining system functions.

After the desired number of cards have been played in the blackjack game, the dealer removes any unplayed cards from the card-dispensing shoe and places them on top of the cards previously removed from play. The dealer actively signals completion of play to the processor by operating a control switch located adjacent to the discard shoe. Alternatively, several passive methods are available to perform this function.

The system gathers information on the distribution of cards in the discard shoe from knowledge of the sequence of cards dealt during game play. When signaled, the system determines appropriate sequence, number, and positions of the pre-shuffle plug locations of the cards in the discard shoe. The system transmits the pre-shuffle card plug information to an output device driver assembly which actuates the desired output devices. In one implementation, the system output devices are light-emitting diodes, but any number of electric, acoustic, or mechanical devices could be utilized.

The dealer plugs the card segments as directed by the system output devices and signals completion by operating the control switch discussed above. The process is repeated until the card segments are properly positioned and then the system transmits an output signal to direct the dealer to shuffle the cards. This pre-shuffle mixing technique significantly reduces the post-shuffle statistical deck variations and improves current pre-shuffle mixing practices which are performed arbitrarily by the dealer and do not ensure adequate and consistent distribution of the card values following the shuffle.

During play, the system monitors the cards received by the dealer and actuates an output device any time the dealer's first two cards consist of an ace and any ten-valued card. When the first card received by the dealer is an ace, the passive table mounted sensor delays actuation of the output device until all players have had the opportunity to place an optional blackjack game wager commonly referred to as insurance.

A computer system, located remotely within the casino, executes several software programs to support the system-level tasks.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
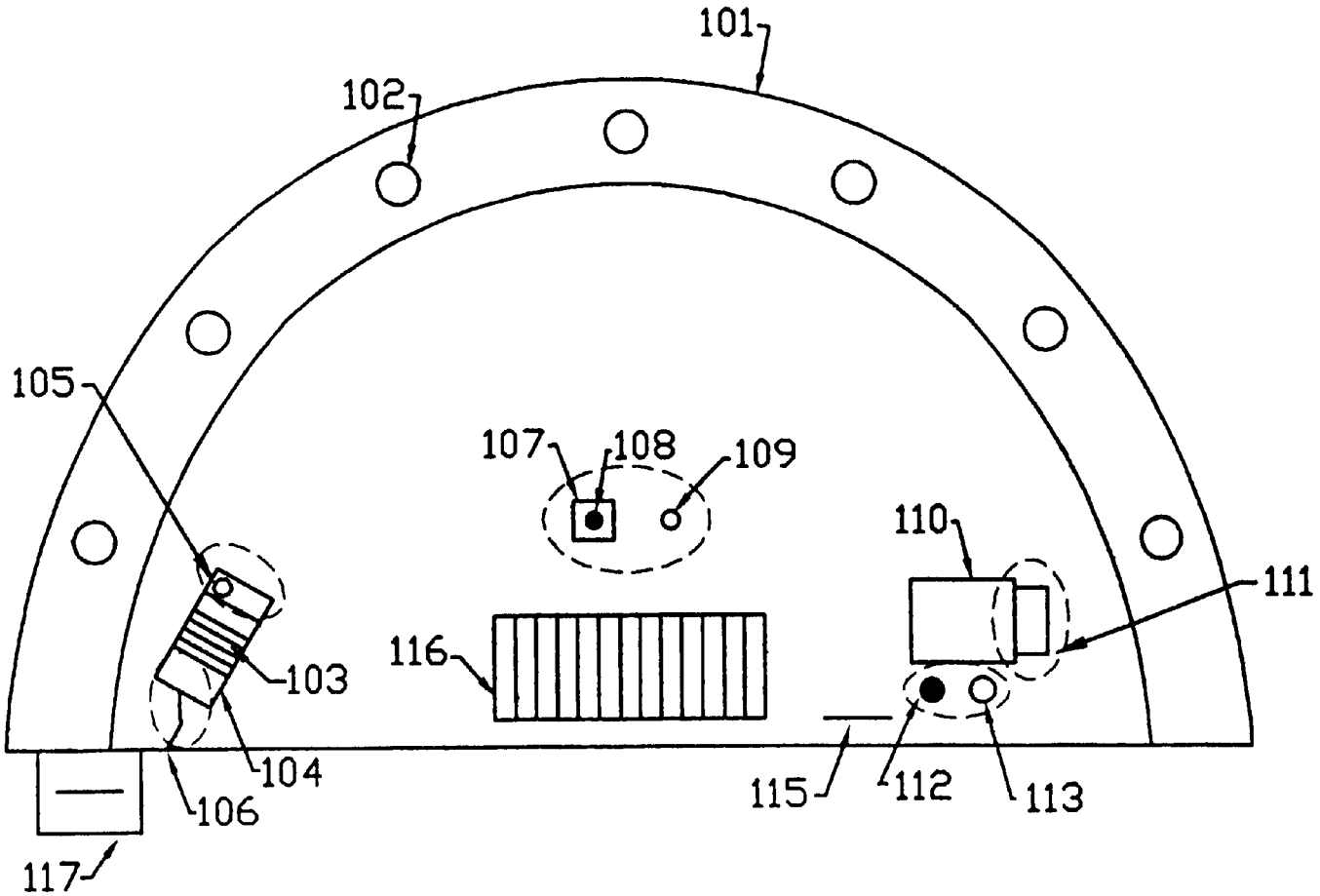
FIG. 1 is a top view of one embodiment of the system hardware devices installed on a common blackjack table.
Figure 2:
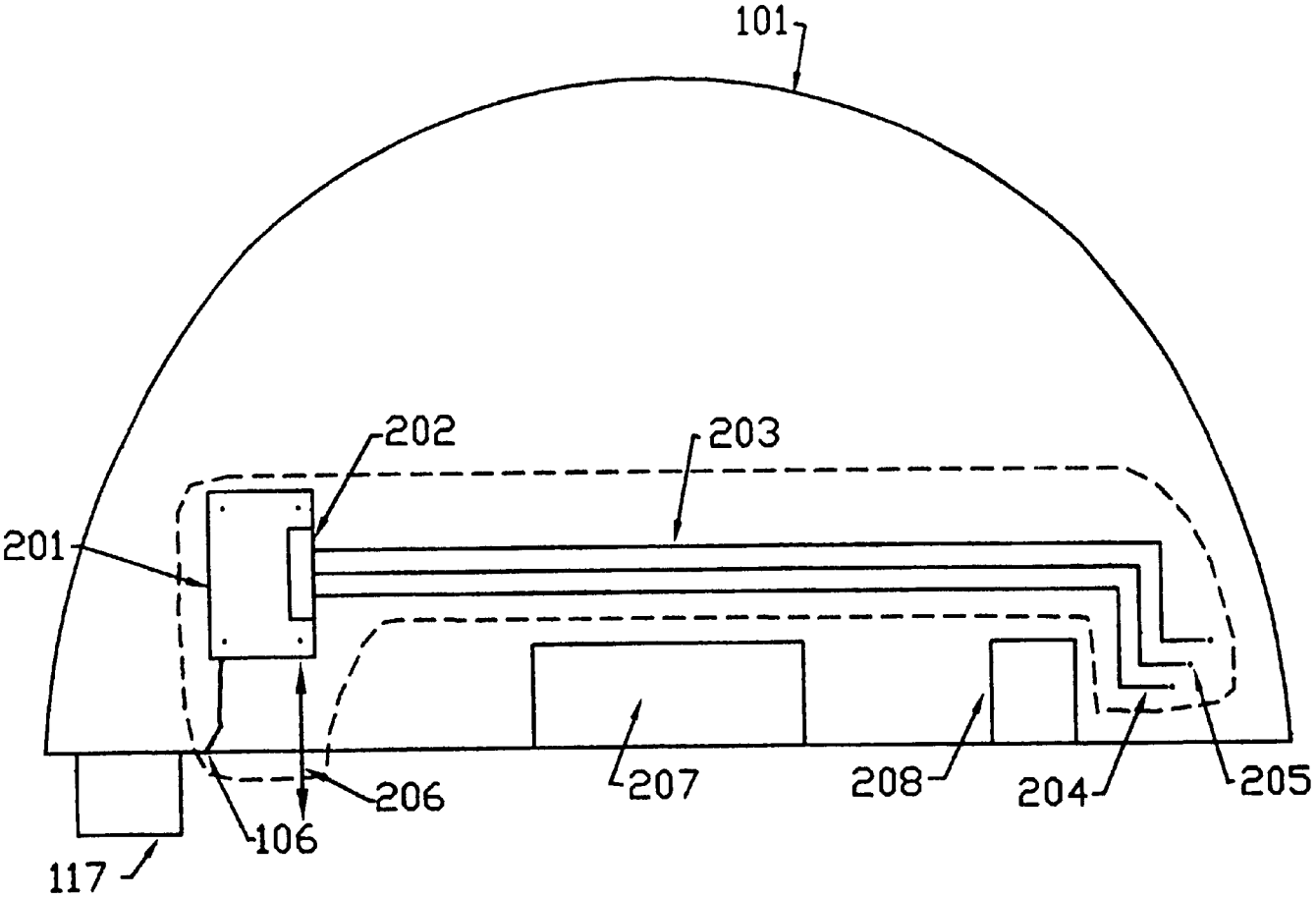
FIG. 2 is a face view of hardware components of the system of FIG. 1 installed on the underside of a common blackjack table.

FIGS. 1 and 2 illustrate the system hardware components, according to one embodiment of the present invention, as installed on a common casino blackjack table 101. The dotted lines in FIGS. 1 and 2 indicate the locations of the system components attached to the table. The system components may be attached to the table using conventional means such as ordinary threaded screws or bolts.

In FIG. 1, the top surface of the table 101 encompasses the area over which the game is played. The betting circles 102 depict the areas where the players' bets are placed. The cards 103 are normally stored in the card-dispensing shoe 104 and travel directly over the card-recognition sensors 105 as they are dealt from the dispensing shoe. As the card travels over the recognition sensors, an electrical output signal is transmitted to the dedicated signal board (DSB) 201 of FIG. 2 via an electrical cable 106.

During each round of play, the dealer's cards are stored on the table in area 107 over the table-mounted sensor 108. Alternatively, a remote sensor can perform the function of the table-mounted sensor. The sensor can be any passive or active switching device such as a microswitch, photocell or proximity sensor. In one implementation, the table-mounted sensor is a phototransistor. The table-mounted sensor transmits an electrical signal back to the DSB to indicate the presence or absence of a card in the dealer's card-storage area. The system utilizes this information to determine the number of players in a given round, detect the completion of a round of play, and control actuation of the system output device 109 when the dealer's face up card is an ace and the face down card is a ten-valued card. The latter function is necessary to ensure that all players have had an opportunity to place a special bet commonly known as "insurance" prior to actuating the system output device.

The system output device 109 is mounted adjacent to the dealer's card-storage area. This system output actuates whenever the first two cards received by the dealer correspond to a blackjack hand. The system output device can be any acoustic or visual signaling device. In one implementation, the system output device is a light-emitting diode (LED).

Cards removed from play are stored in the discard shoe 110. Another system output device 111 is mounted adjacent to the discard shoe. This output device can be any visual or acoustic device. In one implementation, this output device is an LED assembly. This output is used to indicate the desired position of the card segments prior to shuffling.

An operator control device 112 is mounted on the table near the discard shoe 110. The operator control device can be any active or passive switching device. In one implementation, the operator control device is a manually operated electrical switch that is connected to the DSB. This switch is used to control actuation of the discard shoe output device 111.

A table-mounted output device 113 is mounted on the table adjacent to the operator control device 112. This output informs the dealer to begin shuffling and can be any acoustic or visual signaling device. In one implementation, this output is an LED.

In addition to the components described above, a currency insert slot 115, chip storage rack 116, and dealer gratuity box 117 are commonly mounted on the table. The system components do not interfere with any of these conventional components.

FIG. 2 depicts the underside of table 101. Electrical cable 106 connects the card-recognition sensors to the dedicated signal board (DSB) 201. The DSB can be mounted to the underside of the blackjack table as shown. The DSB transmits power to the table-mounted system components and conditions the sensor and operator control device output signals as required. The DSB is connected to the system output and operator control devices via the dedicated LED driver 202 and electrical cables 203, 204, and 205. The DSB interfaces with the system interface assembly 801 of FIG. 8 via electrical cable 206 to transmit and receive system operating information.

In addition to the system components described above, a chip tray cover storage rack 207, money drop box 208, and dealer gratuity storage box 117 are commonly mounted to the underside of the table, but do not interfere with any of the system components.

Figure 3:
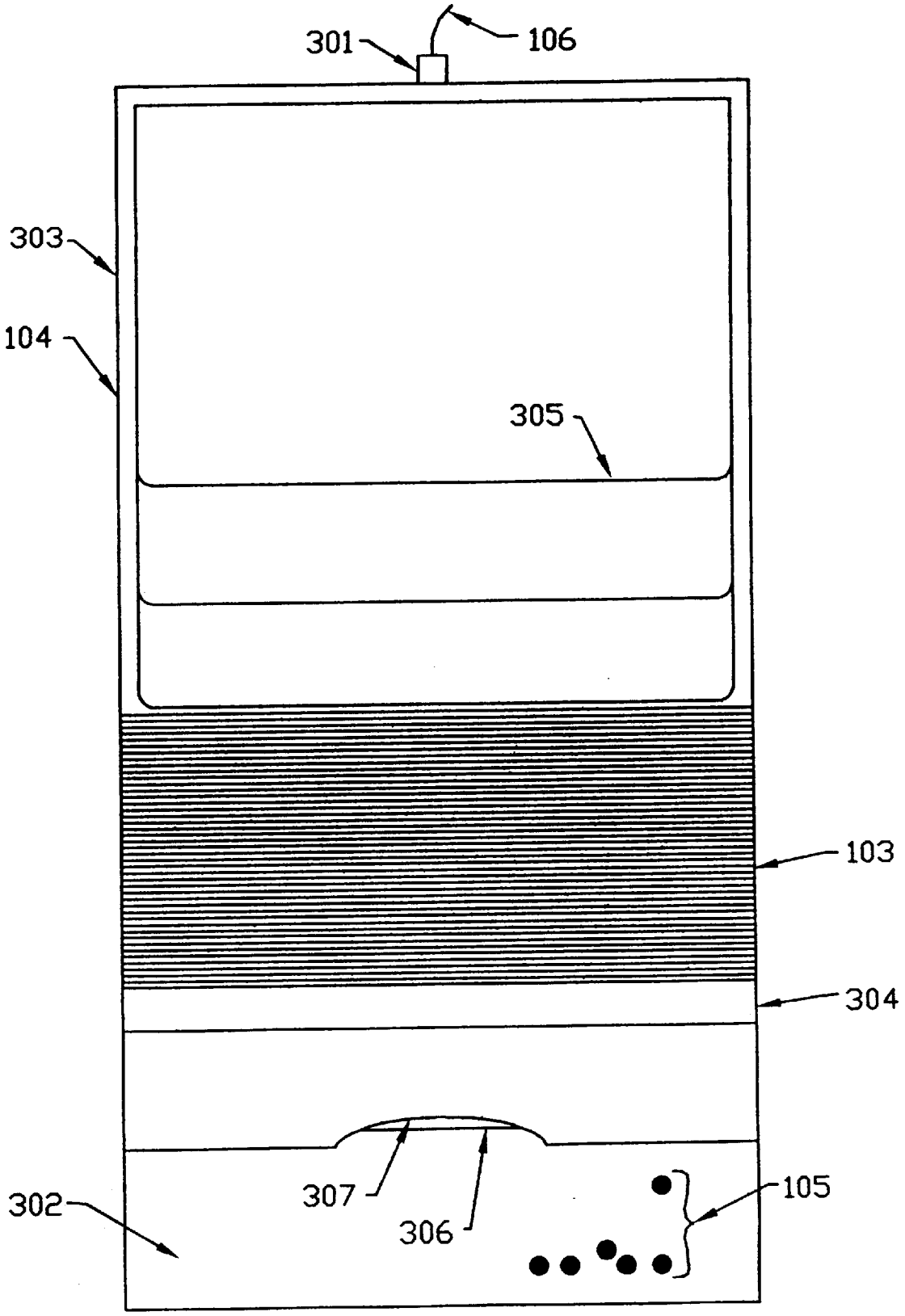
FIG. 3 is a top view of a card-dispensing shoe, according to one embodiment of the present invention.
Figure 4:
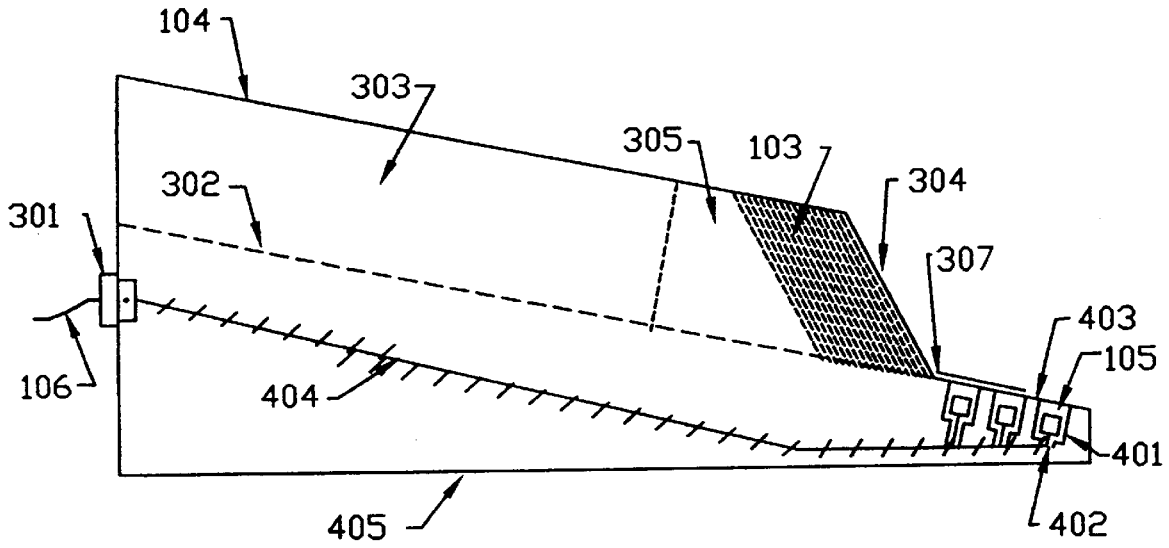
FIG. 4 is a side view of the card-dispensing shoe of FIG. 3.

FIGS. 3 and 4 show the top and side views, respectively, of card-dispensing shoe 104 of FIGS. 1 and 2. Dispensing shoe 104 is based on a common playing card-dispensing shoe distributed by Paul-Son Casino Supplies, Inc. of Las Vegas, Nev. The configuration of dispensing shoe 104 includes card-recognition sensors 105 (preferably six as shown in FIG. 3), internal wiring 404 of FIG. 4, electrical connector 301, and electrical cable 106. A standard dispensing shoe is designed to store a plurality (typically up to eight decks) of cards. The cards 103 rest on an inclined baseplate 302 and are contained between the sidewalls 303 of the shoe, the frontpiece 304, and a sliding block 305. The standard sliding block has an inclined face and exerts a constant force to maintain the cards against the frontpiece. The frontpiece is designed to allow the dealer to manually remove the cards from the shoe, one at a time. The cards are manually dispensed from the shoe by exerting force on the leading edge of the top card 306 and pushing the card through a small opening 307 between the frontpiece and the baseplate. The opening and frontpiece are designed to allow only one card at a time to be dispensed. Other commonly available shoes contain either a shutter door or a curtain which do not interfere with the system sensors. As a card is dealt, it travels over the card-recognition sensors. These sensors transmit signals to the DSB indicative of the removal of a card from the dispensing shoe as well as its value.

In one embodiment, the card-recognition sensors are reflective object sensors that are available commercially from a large number of manufacturers such as Optek Technology Inc. of Carollton, Tex. Alternatively, other sensors, sensitive to gross color or selective gray scale changes, such as cameras or charge coupled devices, could support the card-recognition function.

Preferred card-recognition sensors are compact and can be readily installed in any commercially available card-dispensing shoe. The sensors are recessed in sensor mounting holes 401 drilled into the baseplate of the card-dispensing shoe and retained in place using conventional means such as glue. The card-recognition sensors are mounted at pre-determined locations to ensure that all required features necessary to determine the card value can be detected. The exact sensor locations can be selected to detect the value of any commercially available casino playing card.

The card-recognition sensor electrical leads 404 are routed through signal lead holes 402 underneath the baseplate to electrical connector 301 located on the back of the shoe. Electrical cable 106 connects the card-recognition sensors to the DSB.

The cards 103 rest on the inclined baseplate 302 which extends the entire length of the shoe. The cards are stored in the shoe between the frontpiece 304, sliding block 305, and sidewalls 303. The cards are manually dispensed from the shoe through an opening 307 between the frontpiece and the baseplate. A card 403 is shown positioned over the card-recognition sensors. The sensors are mounted perpendicular to and recessed below the plane of the baseplate to prevent interference with the cards during removal from the shoe and also to optimize the sensor output response. The volume between the baseplate and the bottom 405 of the shoe is open and provides a path for routing the sensor electrical leads 404 to the output connector. The signal lead holes 402 are smaller in diameter than the sensor mounting holes 401. The diameter difference between these two holes provides a mounting surface for the card-recognition sensors.

Figure 5:
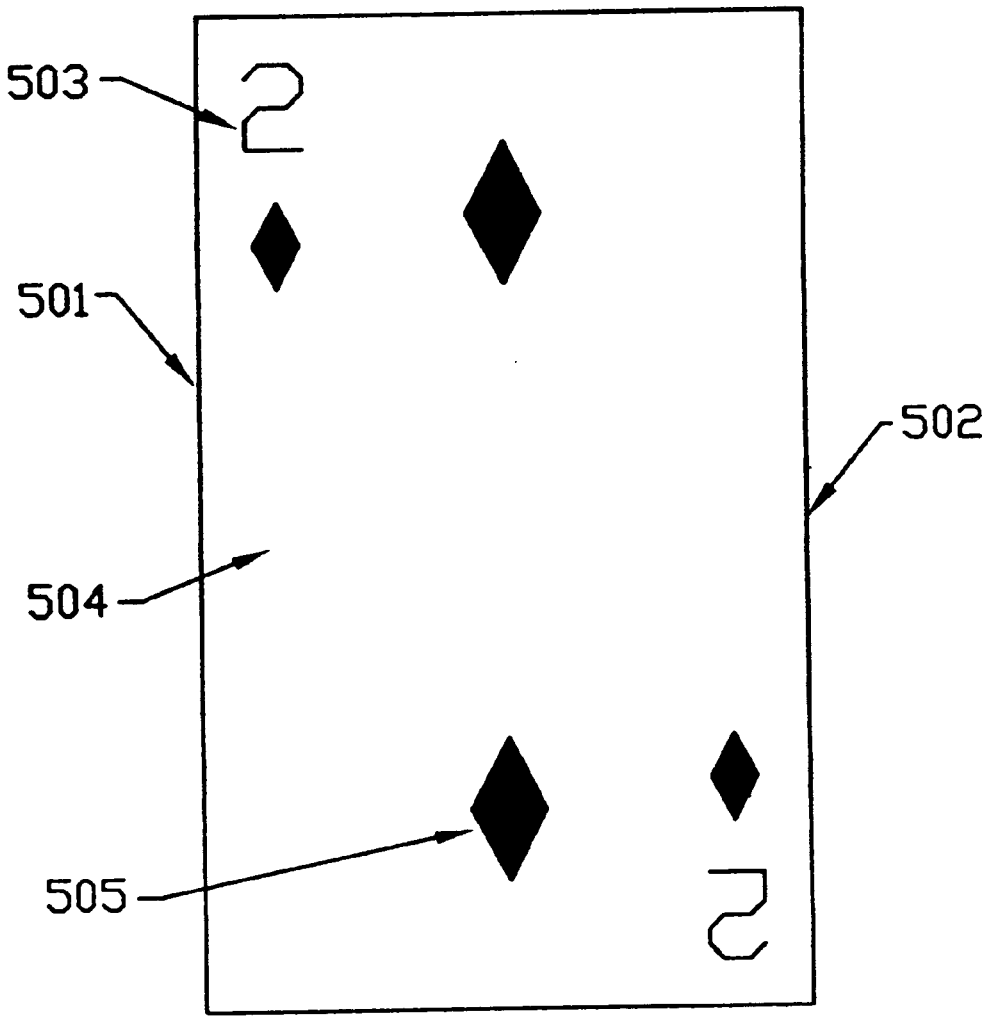
FIG. 5 is a face view of an ordinary playing card.

FIG. 5 depicts the face view of an ordinary casino playing card. Standard casino playing cards are available from a large number of manufacturers such as the Gemaco Playing Card Company of Independence, Mo. The arrangement of features on the card face view can vary depending on the playing card vendor. The card face view is adjacent to the card-recognition sensors during removal of the card from the shoe. The card is pushed past the sensors from the leading edge 501 to the trailing edge 502. The card consists of lighter areas 504, and darker areas which correspond to the card indices 503 and the card pips 505. Typically, the lighter areas are white in color and the darker areas are black or burgundy, depending on the suit. The graphics contained on face cards (i.e., Jacks, Queens, and Kings) generate distinct output signals (e.g., having a relatively large number of transitions between light and dark areas) that are discernable by the system.

Figure 6A:
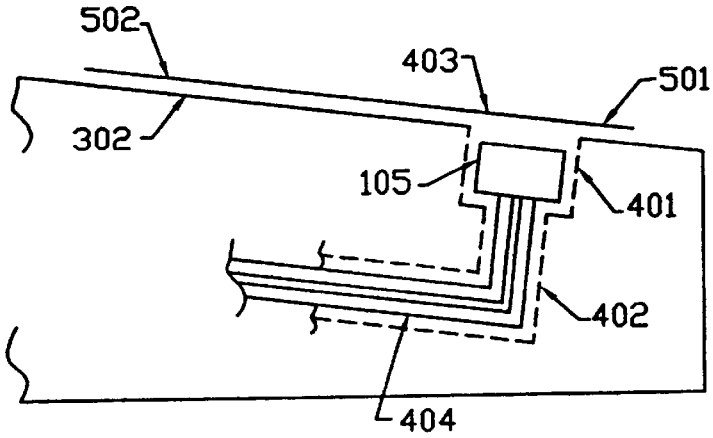
FIG. 6A is a side view showing sensor alignment in the shoe of FIG. 3 relative to the card being detected.

FIG. 6A is an expanded view of playing card 403 traveling over a card-recognition sensor 105. The card 403 rests on the surface of the card-dispensing shoe baseplate 302. The leading edge 501 of the card has traveled past card-recognition sensor 105 while the trailing edge 502 has not. The card does not physically touch the sensor during removal from the shoe. The sensor mounting hole 401, sensor lead hole 402, and sensor electrical leads 404 are also shown for clarity.

Figure 6B:
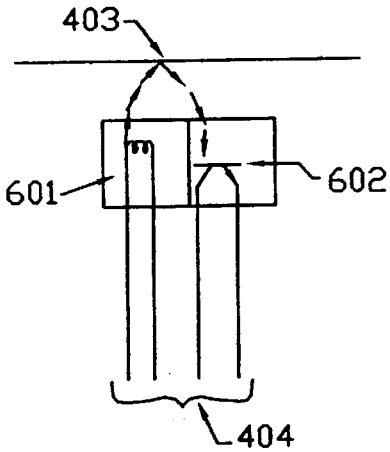
FIG. 6B is a side view of the sensor radiated output path when positioned under a light portion of a playing card.

FIG. 6B represents the operation of card-recognition sensor 105 while a lighter portion of card 403 is directly over the sensor. In this embodiment, the card-recognition sensor is a reflective object sensor. This type of sensor is able to discern the light and dark areas on the card. The reflective object sensor comprises an infrared emitting diode (IED) 601 and a phototransistor 602 mounted side by side in a discrete component housing. The IED 601 is continuously energized from the DSB through the electrical leads 404. The IED emits non-visible infrared radiation which is reflected by the light surface of the card 403 back to the phototransistor. The reflected radiation switches the phototransistor to an "on" condition allowing a signal to be transmitted from the phototransistor back to the DSB.

Figure 6C:
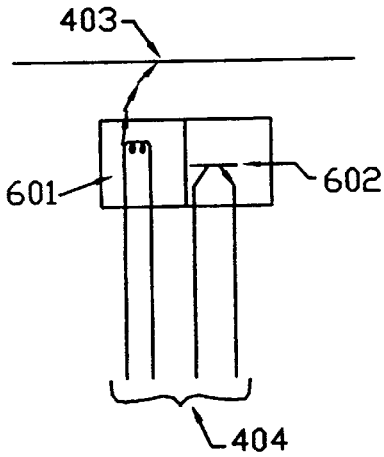
FIG. 6C is a side view of the sensor radiated output path when positioned under dark portion of a playing card.

FIG. 6C illustrates operation of the preferred reflective object sensor when a dark portion of the card 403 is over the sensor. In this case, significant IED-emitted radiation is absorbed by the card and does not return to the phototransistor 602. Thus, the phototransistor return signal to the DSB is interrupted. In actual practice, the dark portion of the card reflects a small amount of the emitted radiation back to the phototransistor. This allows some current flow back to the DSB, however, the amount of current is much less than that returned from a light area, and the DSB is designed to electrically discriminate between the two signals.

The reflective object sensors are selectively located in the card-dispensing shoe to identify the key light-to-dark transitions indicative of the card pips. The number and location of the pips is unique for each card value. Alternatively, the pips could be detected using a position-based methodology that would analyze discrete segments of the sensor output data based on the card speed and expected pip locations.

Although the card-dispensing shoe is preferably configured with an array of card-recognition sensors that generate unique signals indicative of each specific card value, it is possible to implement the present invention with a few as one sensor positioned to indicate (e.g., from the number of light-to-dark and dark-to-light transitions) whether or not each dispensed card has a value of ten in the game of blackjack.

The recognition of cards is insensitive to typical variations in the speed at which individual playing cards are dispensed from the card-dispensing shoe during card game playing.

Figure 8:
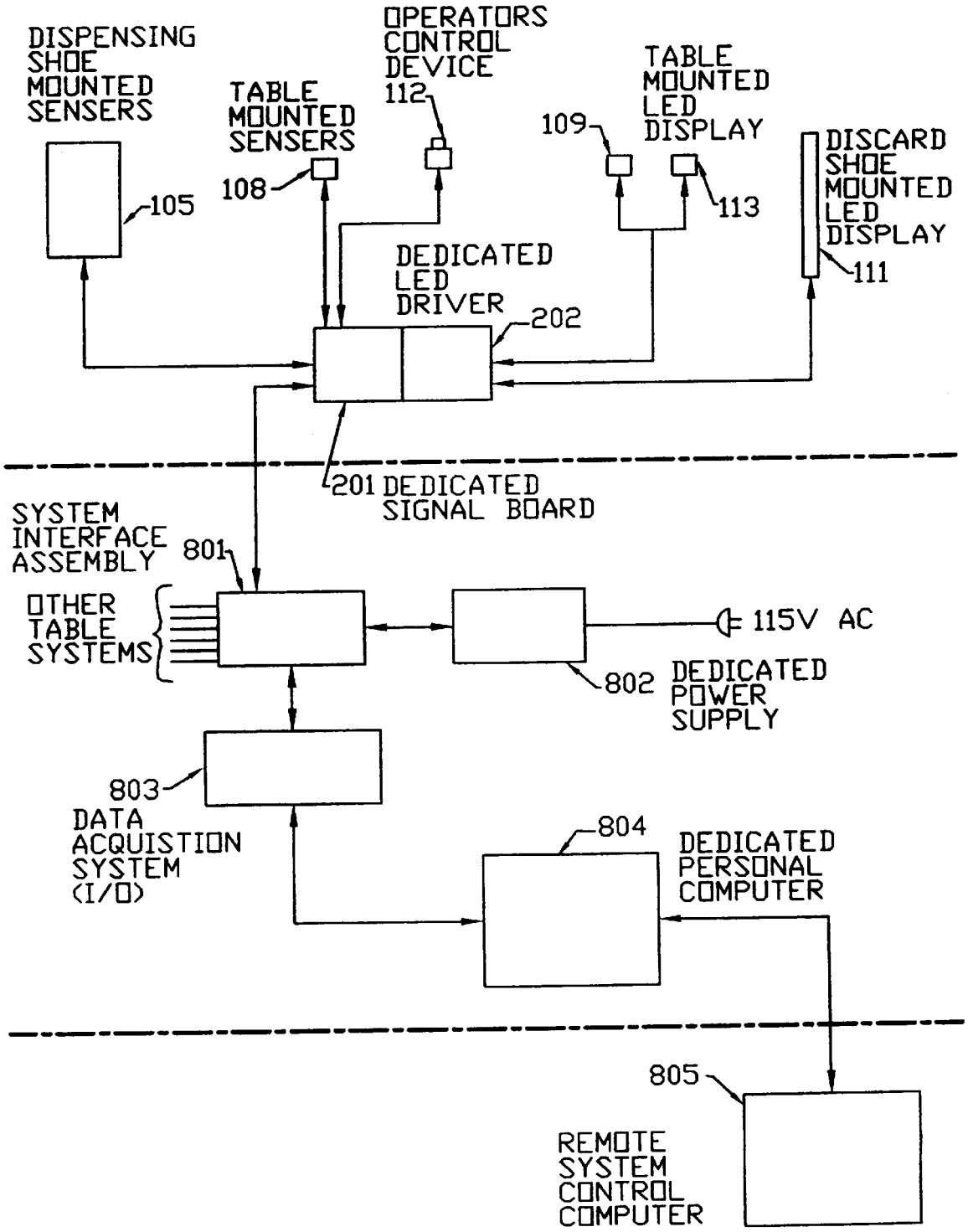
FIG. 8 shows a system architecture block diagram, according to one embodiment of the present invention.

The integrated sensor output signal is conditioned by the DSB and then transmitted to the system computer 804 of FIG. 8 via the data acquisition system 803. The system computer determines the card value based on the number and locations of the pips. The system is able to recognize all card values instantaneously upon removal from the shoe. Additionally, the system can detect the card values with the maximum card-to-sensor spatial misalignment permitted by existing commercial dispensing shoes. The table mounted sensor and one of the card-recognition sensors is a phototransistor. The phototransistors detect the presence or absence of a card over the sensor. When a card is not over the sensor, ambient light turns the phototransistor "on" allowing the phototransistor to return current back to the DSB. When covered by a card, the phototransistor is "off" and does not return current to the DSB.

Figure 7:
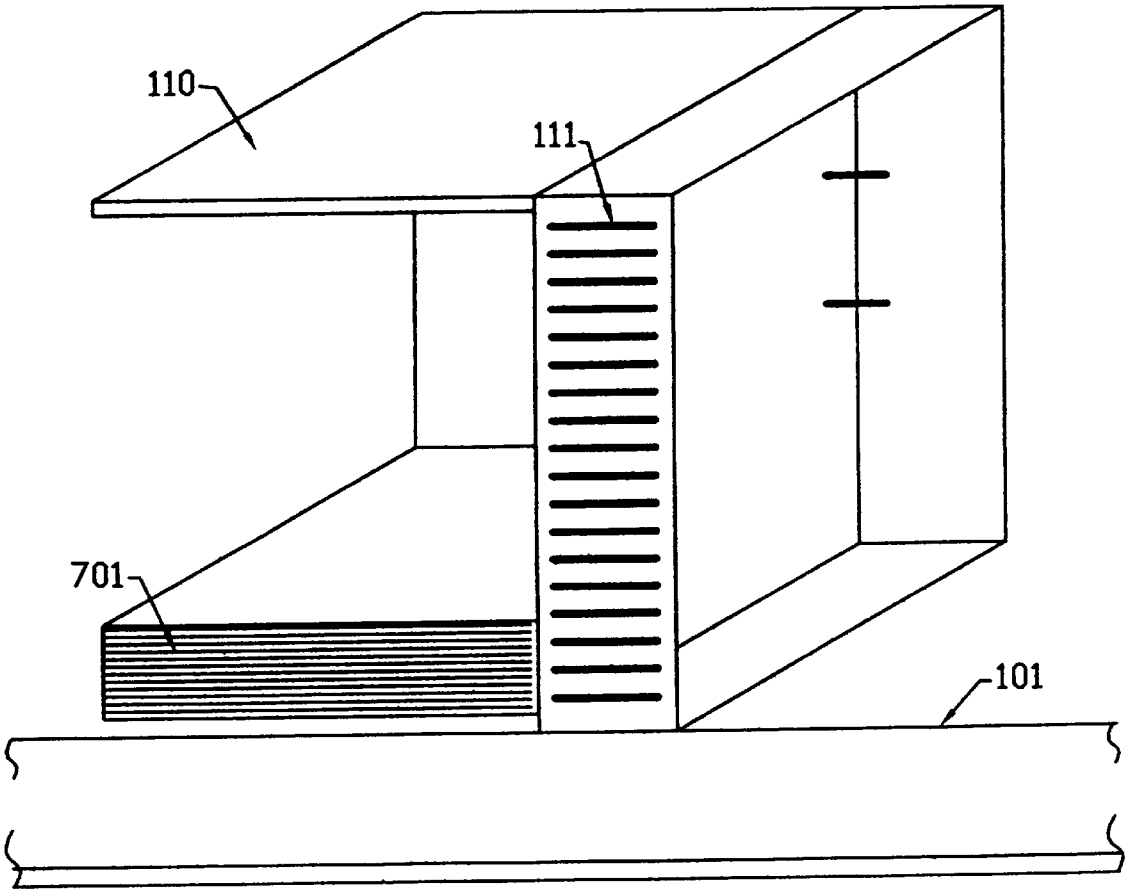
FIG. 7 is a front perspective view (as viewed by the dealer) of a card discard shoe, according to one embodiment of the present invention.

FIG. 7 is a front perspective view (as viewed by the dealer) of system output device 111 of FIG. 1 attached to card discard shoe 110. The discard shoe, which may be based on discard shoes produced by a number of commercial vendors, stores the cards 701 as they are removed from play. The discard shoe is typically mounted on the surface of the table 101 and secured at a fixed location with conventional means such as a threaded screw. System output device 111, which is mounted adjacent to the discard shoe, preferably has an LED assembly. The system transmits discrete signals to the dedicated LED driver (DLD) 202 of FIG. 2 to illuminate the desired LEDs. The DLD is a commonly available LED driver assembly such as that manufactured by National Semiconductor of Santa Clara, Calif.

The system illuminates the LEDs as required to signal the card-segment mixing sequence to ensure the proper distribution of the card segments prior to mixing. The card segment illuminated by the upper LEDs is removed and placed immediately below the card segment illuminated by the lower LED. The dealer would perform this activity and then actuate the operator control device 112 to signal to the system that the card segment was relocated. In one embodiment, the operator control device 112 is a simple contact pushbutton. This sequence would be repeated until the desired pre-shuffle card distribution was achieved. The system would actuate the system output device 113 to direct the dealer to begin the shuffling process. In one embodiment, the system output device 113 is an LED.

The dedicated personnel computer 804 of FIG. 8 computes the desired pre-shuffle position for each card segment by an algorithm designed to minimize the absolute value of the sum of the post-shuffled statistical advantage of each card segment. The algorithm computes the sum of the absolute values of each card segment in the post-shuffled deck by combining the statistical advantages of the card segments as they are mixed during the shuffling process. The final card-segment advantage is a function of the casino's pre-determined shuffling pattern as well as the statistical advantage of each pre-shuffled card segment. Thus, the algorithm determines which pre-shuffle card-segment pattern results in the minimum absolute value of the sum of the advantage for each post-shuffled card segment.

FIG. 8 reflects the integrated individual system components within the system architecture, according to one embodiment of the present invention. The card-recognition sensors 105 provide a continuous output signal to the DSB 201. A comparison circuit within the DSB discriminates between the signals generated by the light and dark portions of the playing card. The DSB conditions and transmits the signal to the system interface assembly (SIA) 801. The output signal is unique for a given card value. The DSB also accepts input signals from the table-mounted sensor 108 and the operator control device 112. These signals are also conditioned and transmitted to the SIA. All components connected to the DSB, except the SIA, correspond to an individual table.

The DSB 201 converts the analog output voltages from the card recognition sensors 105 into digital output signals. Appropriate voltage threshold levels are established so that the digital output signals from the dedicated signal board 201 are a function of whether the white areas 504 or non-white (pip) areas 505 of a playing card are over the card recognition sensors 105. In one implementation, the card-dispensing shoe is configured with multiple active sensors 105 and one passive sensor 105. The active sensors report a digital '1' when a suitable reflective surface is near the sensor, e.g. a white portion 504 of a playing card, and report a digital '0' otherwise. The passive sensor output is converted to a digital '1' from ambient room illumination and a digital '0' when a playing card obscures the sensor. The passive sensor output is used to determine when a playing card is being dispensed from the shoe.

The digital output signal is transmitted through the system interface assembly 801 to a commercial data acquisition system 803. A dedicated personal computer 804 samples the digital output signal at a pre-determined rate. The passive sensor output is used to determine the leading and trailing edges of the playing card. As the card passes over the sensors, the dedicated personal computer 804 runs a state machine per sensor that determines whether the sequence of digital '1's and '0's indicates that a pip has passed over a particular sensor. An example of such a sequence might be "at least two '1's followed by at least one '0' followed by at least two '1's. Each digital '1' or '0' causes the state machine to alter its state based on its current state and the new input. When a sequence of digits representing a pip is input to the state machine, the state machine will increment a counter. Sequences that do not indicate a pip do not cause the state machine to increment the counter.

Once the trailing edge of the card has passed the sensors 105, the counters from each of the state machines are passed to a heuristic pattern matching engine. The engine uses a combination of rule-based decisions and template matching to attempt to determine the value of the playing card. A rule-based decision might declare that a count greater than three on any sensor indicates the presence of a face card or an Ace of Spades having a large decorative spade. A template-based match might declare that a count pattern of '0 1 0 0 1 0' is a "two" card based on the known positions of the sensors relative to the locations of the card pips. A third portion of the pattern-matching engine computes a distance metric between a detected pattern and known templates when no exact match is found. The distance is computed as the sum of the absolute value of the difference in detected count versus template count for each of the active sensor counts. This distance can then be used to make a best 'guess' for the detected pattern.

The SIA provides the necessary hardware interface between the DSB of one or more tables, the dedicated power supply 802, and the data acquisition system 803. The dedicated power supply is a commercially available power supply and provides the necessary power to the system components. The data acquisition system is a commercially available data input/output computer board such as that manufactured by National Instruments of Austin, Tex. The data acquisition system samples each DSB output signal at the desired rate and inputs this data to the system computer 804. The data acquisition system also provides the interface to transmit computer system output signals to the desired system output devices.

The system computer accepts the DSB inputs signals, performs necessary computations, and transmits output signals to the DSB. Additionally, the system computer can also interface with a remote system computer 805. The system computer utilizes specially developed software programs to accomplish three primary functions and several subfunctions. The primary functions include, but are not limited to, establishing the desired pre-shuffle card segment distribution, signaling that the dealer's hand comprises a blackjack hand, and transmitting the desired dealer operational performance data to the remote system computer.

The system components unique to an individual blackjack table are shown in FIG. 8. The system interface assembly 801 may interface with the system components of all the blackjack tables contained within the casino or with a smaller subset of tables located close together within a specific area in the casino commonly referred to as the pit. The system measures and stores a number of objective blackjack game parameters related to the speed and level of participation in the blackjack game such as rounds/hour, players/table, shuffling speed, and deck penetration. This information can be viewed in real time on the remote system control computer 805 or stored automatically and printed for subsequent review. The system collects this information automatically and provides an important input to the casino management decision making process. Specifically, the dealer performance and blackjack game operational data can be utilized to enhance a number of key management decisions, including the popularity of certain blackjack game promotions, dealer personnel management and training policies, and matching the number of open (short-term) or installed (long-term) blackjack tables to the measured level of use.

The system computer subfunctions include, but are not limited to, determination of dealer specific statistics related to the performance of each dealer; the value of each card removed from the dispensing shoe; the number of cards played during each round of play; the approximate location of each card in the discard shoe; the number of hands played in a round; whether the dealer's first two cards correspond to a blackjack hand; the number of rounds played in a specified time period; the statistical advantage of the cards remaining in the dispensing shoe as well as in each segment in the discard shoe; the proper method for distribution of the card segments prior to the shuffle process; and what tables require enhanced monitoring due to certain system malfunctions or operator performance errors.

The remote system computer 805 is located in a secure area of the casino such as the surveillance room. The remote system computer stores the dealer operational performance data and provides an interface for casino management and security personnel to monitor system and dealer performance. The remote system computer provides an audible and visual indication upon recognition of a system malfunction, inadequate card distribution, or improper system operation to enable the casino to increase the oversight of the affected table. The remote system control computer also provides a means for performing preventive maintenance and diagnostic testing of the system.

Figure 9:
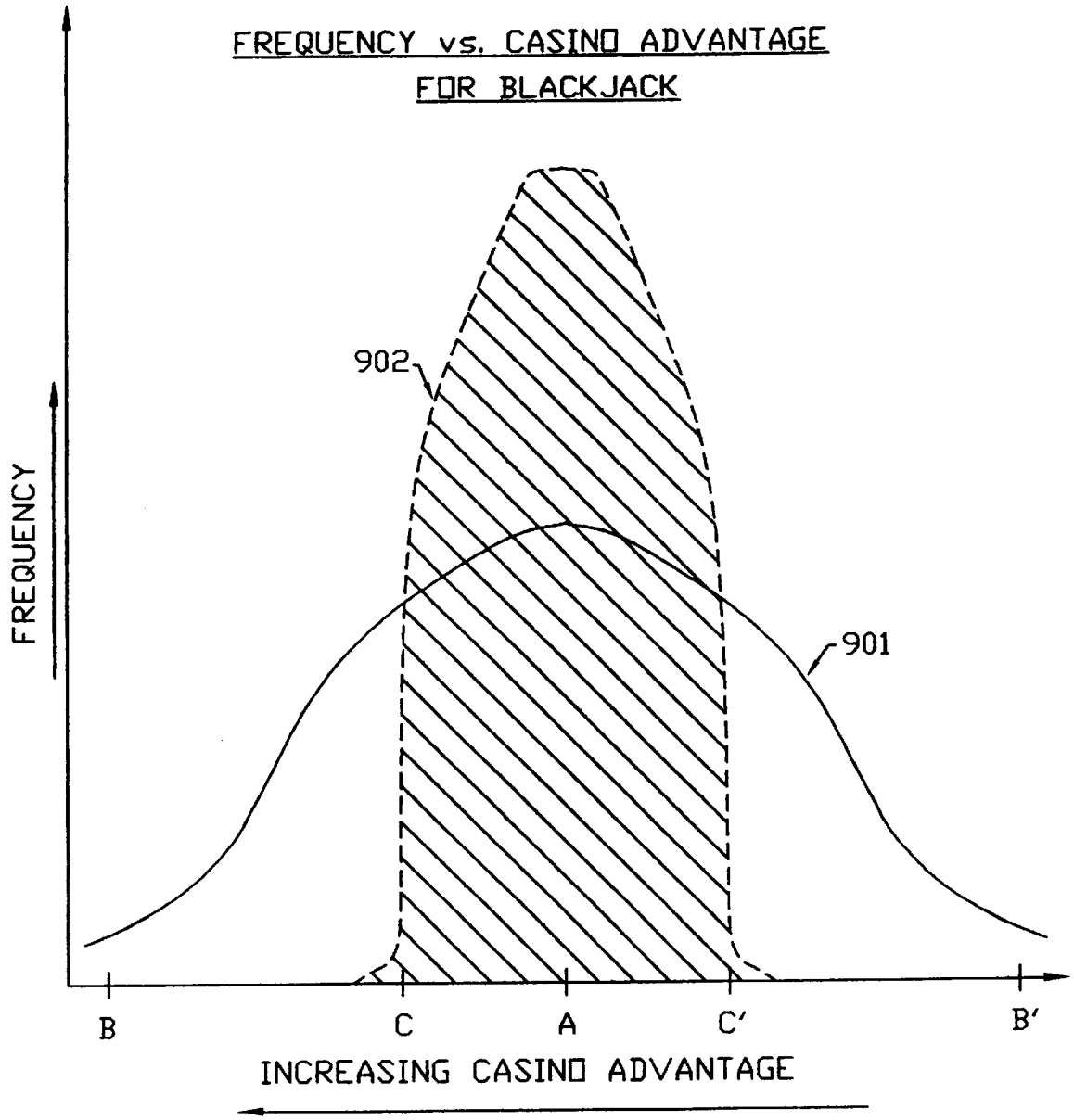
FIG. 9 shows frequency distributions of the casino advantage during play of a blackjack game with and without the enhanced shuffling process of the present invention.

FIG. 9 illustrates the statistical frequency distribution of a blackjack game. Curve 901 displays the distribution that would be expected for a blackjack game utilizing current shuffling practices. The absolute values of the 95% confidence limits, which are shown on curve 901 at points B and B', are a function of the number of decks in play, number of decks played before shuffling, the game rules in effect, and the shuffling effectiveness. The average casino advantage is represented by point A and is a function of several factors including number of decks in play, the number of decks remaining to be played, the rules of the game, and the average skill level of the players in the casino.

The present invention utilizes mathematical algorithms and computer software to determine the optimum position for the pre-shuffle card segments to control the absolute value of the post-shuffled 95% confidence limits (C and C') as depicted in curve 902. The reduced absolute values for the deck statistical condition reflect the more uniform high-to-low card ratio achieved by the enhanced shuffling process. The average player is unaffected by the improved process since the average casino advantage (point A) remains constant. The system passively eliminates the casino's vulnerability to card counters by limiting the frequency of unfavorable statistical deck conditions above C'.

Although we have shown certain preferred embodiments of the present card-recognition and gaming-control device, it should be distinctly understood that the present invention is not limited thereto but may be variously embodied within the scope of the following claims. For example, the present invention can be adapted to operate for card games other than blackjack. In addition, although the present invention is preferably designed to operate with standard playing cards, certain aspects of the present invention (for example, aspects relating to the pre-shuffle card-segment mixing sequence) can be adapted to systems that operate with specially designed playing cards.

What is claimed is:

1. A system for monitoring play of a card game between a dealer and one or more players at a playing table, comprising:

(a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem adapted to:

receive the transition signals generated by the active card-recognition sensors;

determine, in real time and based on the transition signals, playing-card values for the dispensed standard playing cards; and determine, in real time, a current table statistical advantage/disadvantage relative to the players for playing cards remaining in the card-dispensing shoe.

2. The system of claim 1, wherein the signal processing sub-system comprises (1) a signal processor adapted to receive the transition signals from the one or more active card-recognition sensors and (2) a computer adapted to receive signals from the signal processor.

3. The system of claim 1, wherein the card-dispensing shoe comprises a single active card-recognition sensor and the signal processing subsystem is adapted to determine whether or not each dispensed playing card has a playing-card value of ten.

4. The system of claim 1, wherein the card-dispensing shoe comprises an array of active card-recognition sensors positioned to generate signals indicative of each specific playing-card value.

5. The system of claim 4, further comprising a passive sensor adapted to detect a playing card being dispensed from the card-dispensing shoe.

6. The system of claim 1, further comprising:

a dealer-card sensor adapted to generate a card-presence signal indicative of the presence of a playing card for the dealer; and a dealer-blackjack output device adapted to indicate that the dealer's playing cards correspond to a blackjack, wherein:

the signal processing subsystem uses the card-presence signal to determine the current number of players, the values of the dealer's playing cards, whether the dealer's playing cards correspond to a blackjack; and whether to send a signal to the dealer-blackjack output device to indicate that the dealer's playing cards correspond to a blackjack.

7. The system of claim 6, wherein the signal processing subsystem is adapted to delay sending the signal to the dealer-blackjack output device if the dealer has a face-up playing card corresponding to an ace in order to give the players an opportunity to purchase insurance.

8. The system of claim 1, wherein playing cards corresponding to Jacks, Queens, and Kings are detected by the number of transitions between substantially light and dark areas on the playing cards.

9. The system of claim 1, wherein each of the active card-recognition sensors comprises a radiation-emitting device and a radiation sensor.

10. The system of claim 1, wherein the recognition of playing cards is insensitive to typical variations in the speed at which individual playing cards are dispensed from the card-dispensing shoe during card game playing.

11. The system of claim 1, wherein, when configured for operation, the card-dispensing shoe is not fixed to the surface of the playing table to be adjustable for different dealers.

12. The system of claim 1, further comprising a discard shoe configured with a mixing-sequence output device, wherein the signal processing subsystem determines distributions of playing cards in the discard shoe based on sequences of playing cards dispensed from the card-dispensing shoe, determines a desired mixing sequence for positioning card segments during pre-shuffling, and generates signals for the mixing-sequence output device to indicate the desired mixing sequence to the dealer.

13. The system of claim 12, wherein the mixing-sequence output device comprises an array of light emitting devices that are illuminated to indicate the desired mixing sequence.

14. The system of claim 1, wherein the signal processing subsystem is further adapted to monitor dealer performance characteristics.

15. The system of claim 14, wherein the dealer performance characteristics comprise a number of cards being dealt per unit time.

16. The system of claim 14, wherein the dealer performance characterstics comprise shuffling adequacy.

17. The system of claim 14, wherein the dealer performance characteristics comprise shuffling speed.

18. The system of claim 14, wherein the dealer performance characteristics comprise deck penetration.

19. The system of claim 14, wherein the dealer performance characteristics comprise number of players at the playing table.

20. The system of claim 19, wherein the dealer performance characteristics further comprise a number of cards being dealt per unit time, shuffling adequacy, shuffling speed, and deck penetration.

21. The system of claim 1, wherein the signal processing subsystem is adapted to analyze, in real time, occurrences of the playing cards being dispensed to monitor table utilization characteristics comprising one or more of an amount of time the playing table is closed, an amount of time the playing table is open and idle, and an amount of time the playing table is open and active.

22. The system of claim 1, wherein the signal processing subsystem is adapted to receive signals corresponding to two or more playing tables and to generate a signal indicative of the current table statistical advantage/disadvantage for each playing table.

23. A system for monitoring play of a card game between a dealer and one or more players at a playing table, comprising:

(a) a card-dispensing shoe comprising one or more card-recognition sensors adapted to generate signals as playing cards are dispensed from the card-dispensing shoe;

(b) a signal processing subsystem adapted to:

receive the signals generated by the card-recognition sensors;

determine, in real time, playing-card values for the dispensed playing cards; and determine, in real time, a current table statistical advantage/disadvantage relative to the players for playing cards remaining in the card-dispensing shoe; and (c) a discard shoe configured with a mixing-sequence output device, wherein the signal processing subsystem determines distributions of playing cards in the discard shoe based on sequences of playing cards dispensed from the card-dispensing shoe, determines a desired mixing sequence for positioning card segments during pre-shuffling, and generates signals for the mixing-sequence output device to indicate the desired mixing sequence to the dealer.

24. The system of claim 23, wherein the mixing-sequence output device comprises an array of light emitting devices that are illuminated to indicate the desired mixing sequence.

* * * * *